United States Patent [19]

Aranda

[11] Patent Number: 4,825,477

[45] Date of Patent: May 2, 1989

[54] HAIR RETRIEVER TUB DRAIN DEVICE

[76] Inventor: John P. Aranda, 1436 Lake Mango Way, West Palm Beach, Fla. 33406

[21] Appl. No.: 81,402

[22] Filed: Aug. 4, 1987

[51] Int. Cl.[4] ..... A47K 1/14

[52] U.S. Cl. ..... 4/286; 4/292; 4/293

[58] Field of Search ..... 4/286, 287, 288, 289, 4/290, 291, 292, 293, 294, 295

[56] References Cited

U.S. PATENT DOCUMENTS 4,671,976 6/1987 Vidal ..... 4/286

*Primary Examiner*—A. D. Pellinen
*Assistant Examiner*—Morris Ginsburg
*Attorney, Agent, or Firm*—Joseph E. Mason, Jr.; Ronald F. Smith

[57] ABSTRACT

A pair of spring loaded cylinders each supporting an upwardly projecting post mounted in a drain. A strainer is attached to the drain with the posts porjecting upwards through holes in the strainer. A disposable insert, having a hooked material such as VELCRO sheet on its lower surface, is mounted on a distal end of the posts. Foot pressure on a cover plate mounted on a top surface of the insert forces the VELCRO to contact the strainer and remove all impinged hair and debris.

10 Claims, 2 Drawing Sheets

HAIR RETRIEVER TUB DRAIN DEVICE

FIELD OF INVENTION

This invention relates to tub drain devices. More particularly, it refers to a tub drain device incorporating a hair pick up disposable insert for removing hair impinged upon a drain screen.

BACKGROUND OF THE INVENTION

The average homeowner encounters frequent problems with buildup of hair on drain strainers. If left unattended, the hair will move through the strainer and cause a gradual build-up in pipe traps resulting in the plumbing system's loss of ability to rapidly drain away water. U.S. Pat. Nos. 3,742,524 and 4,134,162 describe techniques for trapping hair and preventing movement into the plumbing system. However, they do not provide an inexpensive disposable insert for easily removing hair from drain strainers. Such a device would be of immeasurable assistance to the average homeowner.

SUMMARY OF THE INVENTION

I have solved the problem with a tub drain device incorporating a disposable insert that can be removed and replaced in seconds.

My drain device has a pair of spring loaded cylinders mounted in the drain with an integral hollow upwardly projecting post on each cylinder. A strainer is mounted over the drain with the posts projecting through the strainer. A disk shaped disposable insert is mounted on an end of the posts distal from the cylinder. A bottom surface of the insert has a VELCRO sheet and a top surface is attached to a cover plate. The insert is spaced apart from the strainer in a resting mode. Pressure sufficient to overcome the spring force allows the insert to touch a top surface of the strainer and cause all impinged hair to be lifted from the strainer and onto the VELCRO sheet.

BRIEF DESCRIPTION OF THE DRAWINGS

The present invention may be best understood by those having ordinary skill in the art by reference to the following detailed description when considered in conjunction with the accompanying drawings in which.

DESCRIPTION OF THE PREFERRED EMBODIMENT

Figure 1:
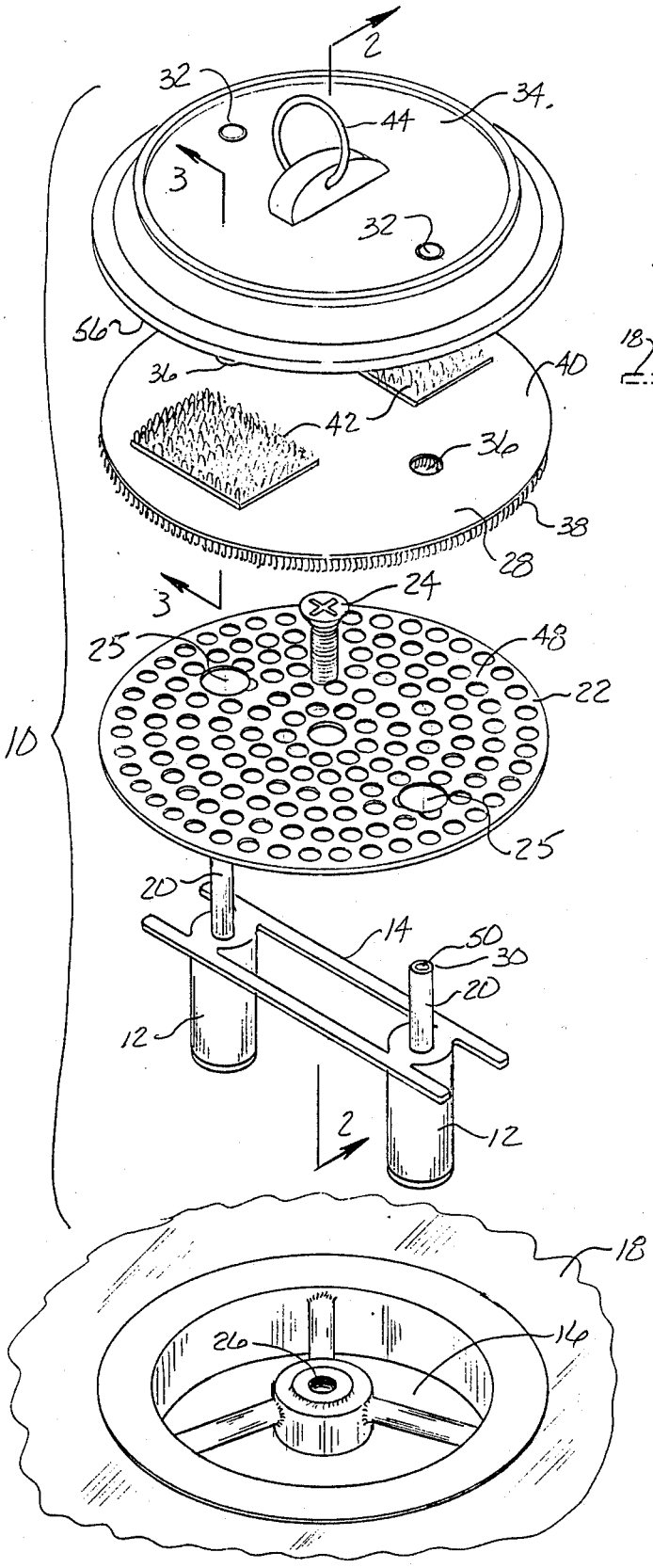
FIG. 1 is an exploded assembly view of the tub drain device of this invention.
Figure 2:
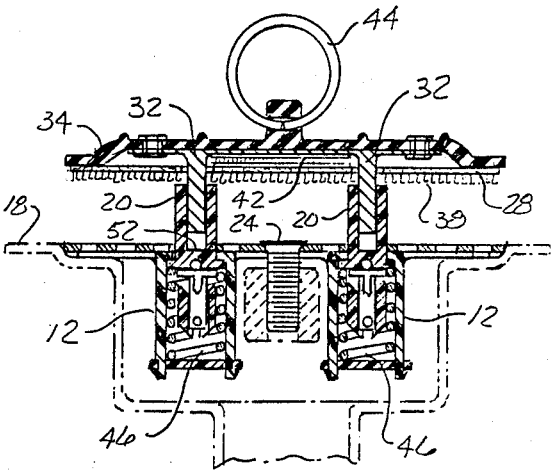
FIG. 2 is a cross-section along line 2—2 of FIG. 1.
Figure 3:
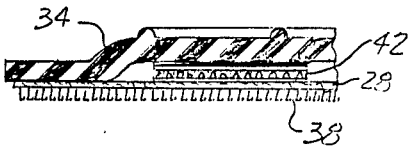
FIG. 3 is a cross-section along line 3—3 of FIG. 1.
Figure 4:
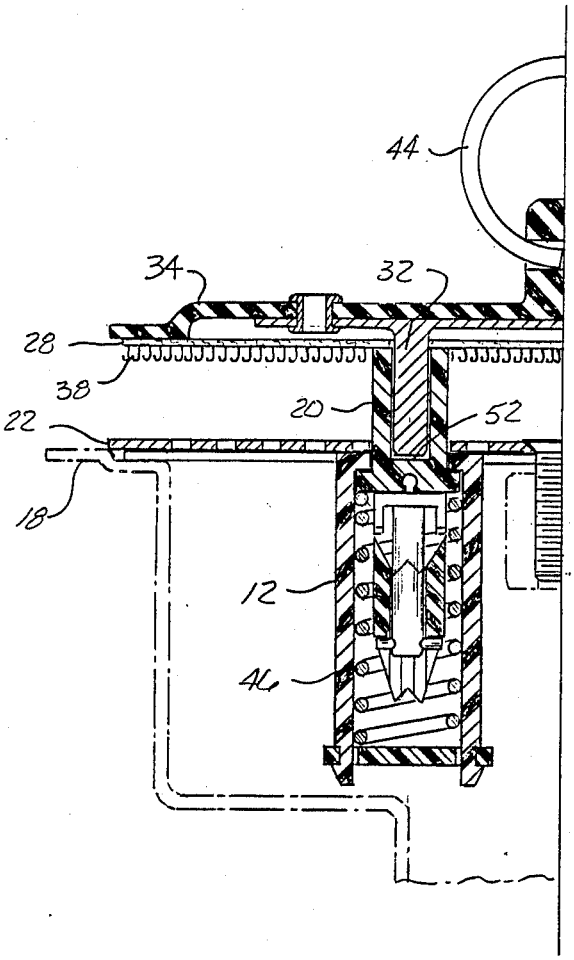
FIG. 4 is a cross-section of the tub drain device inserted into a tub drain in a non-actuated mode.
Figure 5:
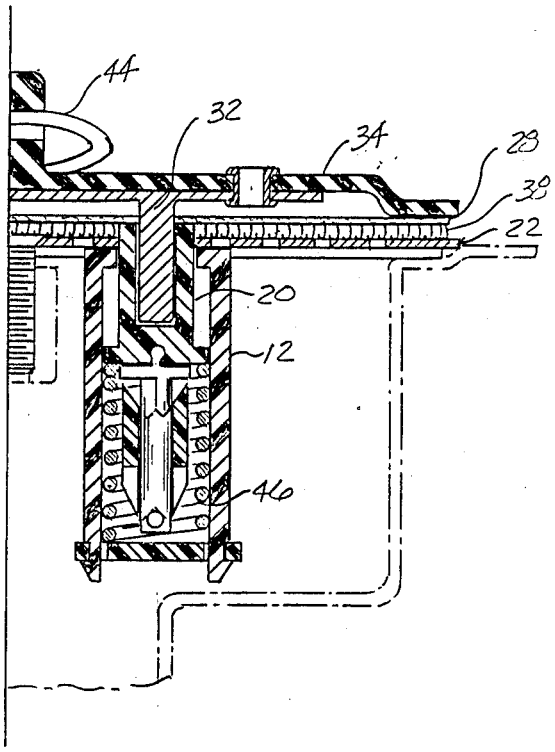
FIG. 5 is a cross-section of the tub drain device inserted into a tub drain and actuated to pick up hair.

Throughout the following detailed description, the same reference numerals refer to the same elements in all figures.

The drain device 10 has a pair of spring loaded cylinders 12 mounted on a bracket 14 and inserted in a drain 16 located usually in a tub 18. Each cylinder has an upwardly projecting cylindrical post 20. A strainer 22 is mounted over the drain 16 and a screw 24 is screwed into the drain screw receptable 26. Holes 25 in strainer 22 are large enough to accommodate post 20 when the strainer is screwed down over drain 16.

Disposable insert 28 is mounted on the distal end 30 of post 20 and is held in place by rivets 32 which are mounted in cover plate 34. The rivets project down through cover plate 34 and through holes 36 in the insert 28. Each rivet terminates within a post 20 to align the various component parts.

Insert 28 is disc shaped and conforms generally to the shape of the strainer 22. Any shape that covers all areas of the strainer would be adequate. A bottom surface of the insert 28 has a water impermeable hair and dirt pick-up element such as hook and loop material named VELCRO 38. The top surface 40 of insert 28 can have additional VELCRO patches 42 to contact and hold the cover plate 34. The cover plate may have VELCRO patches on its lower surface 56 to conform to the VELCRO patches 42 on the upper surface 40 of insert 28.

The cover plate 34 optionally can have a ring 44 to allow easy removal of the cover plate and therefore gain access to the insert 28 for removal.

The springs 46 employed within the cylinders 12 must have sufficient tension to keep the insert 28 spaced apart from the strainer 22 under normal conditions. Foot pressure on cover plate 34 should be adequate to stress the springs to their maximum and allow the bottom surface of the insert 28 to touch the top surface 48 of the strainer 22. As the bottom surface of the insert 28 touches the top surface of strainer 22, any hair impinged upon that top surface will be removed and held by the bottom surface of the insert 28.

The cover plate can be rubber or plastic material suitable to withstand the pressure of a foot pressing down upon the plate. The hair and dirt pick up element can be any substance that is water impermeable and will attract hair and other debris impinged upon the strainer 22. The insert 28 can be a plastic substance or non-corrodable metal at the option of the user. The strainer can be non-corrodable metal or plastic at the option of the user. The cylinder housing can be made of non-corrodable metal or a high density polyethylene or polyester material. The springs will be made of metal.

The rivets 32 will fill the hollow center 50 of the post 20 and when cover plate 34 is initially displaced downwardly, rivets 32 will stop at the bottom surface 52. Pressure on the cover plate causes each post to depress the spring 46 and allow the insert to touch strainer 22.

Although the drain of this invention is usually used in a tub environment where the maximum amount of hair is usually found, it is also usable in the same manner in a shower enclosure or in sinks that can accommodate a strainer. Strainer 22 is not 100% efficient in that some hair can escape down drain 16 through the holes formed therein; however, the purpose of this invention is not to improve the performance of strainer 22 but to pick up the hair that accumulates atop it, i.e., the hair that does not get through. Importantly, if the present inventive structure is not used, a large percentage of the hair accumulating atop strainer 22 will eventually find its way into drain 16 and cause plumbing problems. Clearly, the present invention pioneers the art of strainer top hair retrievers, and the claims appended hereto are therefore entitled to broad interpretation, as a matter of law.

Equivalent elements can be substituted for the elements of this invention without departing from its scope.

Having just described the invention what is claimed to be secured by Letters Patent is:

1. A tub drain device comprising:

at least one spring loaded cylinder for mounting in a drain, a hollow cylindrical post projecting upwardly from an associated cylinder when not under stress, a strainer fixedly mounted over the drain, the post projecting upwardly through an associated hole in the strainer, a disposable insert having a top and bottom surface mounted on a portion of the post distal from the cylinder and spaced apart from the strainer by the post projecting from the spring loaded cylinder in a resting mode, the insert engaging a top surface of the strainer in an actuated mode when the post is depressed against the spring loaded cylinder, said disposable insert including a water impermeable hair and dirt pick up element attached to the bottom surface thereof, and a cover plate removably attached to the top surface of the disposable insert.

2. A tub drain device according to claim 1 wherein at least one rivet is mounted on the cover plate, and passes through the disposable insert.

3. A tub drain device according to claim 2 wherein two rivets are mounted on the cover plate and each fits within associated post.

4. A tub drain device according to claim 1 wherein a ring is mounted on a top surface of the cover plate.

5. A tub drain device according to claim 1 wherein a hooked material is attached to the top surface of the disposable insert.

6. A tub drain device according to claim 1 wherein the pickup element is a sheet of hooked material conforming to the shape of the bottom surface.

7. A device that retrieves hair accumulated atop a strainer for a drain, comprising:

a disposable insert member having a top surface and a bottom surface;

a hair and dirt pick up means secured to said bottom surface;

said insert member having a first position in vertically spaced relation to said strainer and a second position where the hair and dirt pick up means is in contacting relation to said strainer and hence in pick up engagement relation to hair and dirt atop said strainer; and biasing means maintaining said insert member in said first position until driven into said second position by an externally imparted downward force.

8. The device of claim 7, wherein said biasing means includes a cylinder member, and wherein a bias element is disposed within said cylinder member, and wherein said biasing means further includes a hollow post member that surmounts said bias element and which is slidably received into said cylinder member when displaced downwardly by an externally imparted force.

9. The device of claim 8, further comprising a cover plate member secured in overlying relation to said insert member top surface.

10. The device of claim 9, further comprising a rivet member having a top end secured to said cover plate member and a bottom portion slidably received within said hollow post member whereby said rivet member abuttingly engages a bottom wall of said hollow post member and displaces said bottom wall and hence said hollow post member downwardly when said cover plate member is driven downwardly by said externally imparted force, said cylinder member having a height sufficient to receive a substantial extent of said hollow post member so that said hair and dirt pick up means on the bottom surface of said insert member operatively engages hair and dirt atop said strainer when said rivet member abuts said hollow post member bottom wall and drives said post member into said cylinder member responsive to application of said externally imparted downward force upon said cover plate member.

* * * * *